US009916797B2

(12) United States Patent
Hou et al.

(10) Patent No.: US 9,916,797 B2
(45) Date of Patent: Mar. 13, 2018

(54) LIQUID CRYSTAL DISPLAY APPARATUS, SOURCE DRIVER AND METHOD FOR CONTROLLING POLARITY OF DRIVING SIGNALS THEREOF

(71) Applicant: Novatek Microelectronics Corp., Hsinchu (TW)

(72) Inventors: Ching-Wen Hou, Hsinchu (TW); Shun-Hsun Yang, Hsinchu (TW); Tse-Hung Wu, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 78 days.

(21) Appl. No.: 14/716,890

(22) Filed: May 20, 2015

(65) Prior Publication Data

US 2016/0203779 A1 Jul. 14, 2016

(30) Foreign Application Priority Data

Jan. 13, 2015 (TW) ..... 104101086 A

(51) Int. Cl.
*G09G 3/36* (2006.01)

(52) U.S. Cl.
CPC ..... *G09G 3/3614* (2013.01); *G09G 3/3688* (2013.01); *G09G 2300/0426* (2013.01); *G09G 2370/08* (2013.01); *G09G 2370/14* (2013.01)

(58) Field of Classification Search
CPC ..... G09G 2310/08; G09G 2370/14; G09G 2370/08; G09G 3/3614; G09G 3/36; G09G 2310/061
See application file for complete search history.

(56) References Cited

U.S. PATENT DOCUMENTS 8,743,039 B2 6/2014 Tai et al.
2008/0259061 A1* 10/2008 Lin ..... G09G 3/3688 345/204
2010/0027708 A1* 2/2010 Fukuda ..... H04L 25/4917 375/286
2010/0164939 A1* 7/2010 So ..... G09G 3/20 345/213
2012/0062610 A1 3/2012 Tai et al.
(Continued)

FOREIGN PATENT DOCUMENTS

TW 200640190 11/2006
TW 201211998 3/2012
TW 201426722 7/2014

OTHER PUBLICATIONS

"Office Action of Taiwan Counterpart Application", dated Mar. 21, 2016, p. 1-p. 6.

*Primary Examiner* — Gerald Johnson
(74) *Attorney, Agent, or Firm* — JCIPRNET

(57) ABSTRACT

A liquid crystal display apparatus, a source driver, and a method for controlling polarity of driving signals thereof are provided. The source driver includes a signal receiving interface, a decoder, and a controller. The signal receiving interface receives an image data stream or a data input/output indication signal. The decoder obtains polarity controlling information from the image data stream or the data input/output indication signal. The controller receives the polarity controlling information and decides driving polarities of a plurality of source driving signals generated by the source driver according to the polarity controlling information.

12 Claims, 6 Drawing Sheets

(56) References Cited

U.S. PATENT DOCUMENTS

| | | | | |
|---|---|---|---|---|
| 2014/0168183 | A1* | 6/2014 | Yang | G09G 3/3614 345/209 |
| 2014/0176411 | A1 | 6/2014 | Yang et al. | |
| 2014/0184580 | A1 | 7/2014 | Cho | |
| 2016/0118010 | A1* | 4/2016 | Hsu | G09G 5/005 345/213 |

* cited by examiner

LIQUID CRYSTAL DISPLAY APPARATUS, SOURCE DRIVER AND METHOD FOR CONTROLLING POLARITY OF DRIVING SIGNALS THEREOF

CROSS-REFERENCE TO RELATED APPLICATION

This application claims the priority benefit of Taiwan application serial no. 104101086, filed on Jan. 13, 2015. The entirety of the above-mentioned patent application is hereby incorporated by reference herein and made a part of this specification.

BACKGROUND OF THE INVENTION

Field of the Invention

The invention relates to a liquid crystal display apparatus, a source driver and a method for controlling polarity of driving signals thereof, and more particularly, relates to a method for controlling polarity of driving signals without adding extra pins on a source driver.

Description of Related Art

In the existing technical field, a polarity sequence for the horizontal two dot (H2DOT) inversion cycles once per every four channels. Referring to FIG. 1A and FIG. 1B, FIG. 1A and FIG. 1B are schematic diagrams illustrating a method for controlling polarities of source driving signals in the conventional technology. In FIG. 1A, source drivers 110 and 120 connected in series with one another receive polarity controlling information POLA and POLB, respectively, so as to control polarities of source driving signals generated by these source drivers. Herein, the polarity controlling information POLA and POLB may be a digital signal having an N-number of bits to thereby control the source drivers 110 and 120 in order to generate various possible polarity sequences for the source driving signals. According to FIG. 1B, in the condition where driving channels provided by the source drivers 110 and 120 are not a multiple of 4, for maintaining the polarities of source driving signal in a variation sequence of +, −, −+ at an intersection area ITZ of the source drivers 110 and 120, a polarity variation generated by the source driver 120 must be different from that of the source driver 110. This results in an issue similar to a polarity discontinuation occurred when starting the horizontal two dot inversion.

Furthermore, as shown in FIG. 1C which illustrates another method for controlling polarities of source driving signal in the conventional technology, in the recent conventional technology, an inversion technique known as the H4 Inversion that cycles once per every eight channels, is commonly used on a RGBW panel in order solve an image flicker phenomenon caused by the same polarity for neutral colors. Accordingly, it is obvious that the polarity discontinuation may also occur when a total of driving channels is not a multiple of 8.

Based on the above description, in a display of the conventional technology, in order to perform the horizontal two dot inversion mechanism and the H4 Inversion mechanism, it is required to dispose extra pins on the source drivers 110 and 120 to receive different polarity controlling information POLA and POLB, respectively. As such, a number of the pins of in a source driver chip may be increased to increase a layout area of the source driver chip which leads to increases in the circuit costs. Also, since extra transmitting lines are also required in order to provide a polarity control signal to the extra pins of the source driver chip, the circuit costs increase accordingly.

SUMMARY OF THE INVENTION

The invention is directed to a liquid crystal display apparatus, a source driver and a method for controlling polarities of driving signals thereof, which are capable of controlling the polarities of the driving signals without disposing extra pins on the source driver.

The source driver of the invention is adapted to a liquid crystal display apparatus, and the source driver includes a signal receiving interface, a decoder and a controller. The signal receiving interface receives an image data stream or a data input/output indication signal. The decoder is coupled to the signal receiving interface, and obtains polarity controlling information from the image data stream or the data input/output indication signal. The controller is coupled to the decoder, receives the polarity controlling information, and decides driving polarities of a plurality of source driving signals generated by the source driver according to the polarity controlling information.

The liquid crystal display apparatus of the invention includes a display panel, a timing controller, gate drivers and aforesaid source drivers. The source drivers are coupled to the timing controller and the display panel, and the source drivers are connected in series with one another and generate the source driving signals according to the image data stream in order to drive the display panel. The gate drivers are coupled to the timing controller and the display panel, and generate gate driving signals in order to drive the display panel.

The method for controlling polarities of driving signals of a source driver of the invention includes: receiving an image data stream or a data input/output indication signal; obtaining polarity controlling information from the image data stream or the data input/output indication signal; and receiving the polarity controlling information and deciding driving polarities of a plurality of driving signals generated by the source driver according to the polarity controlling information.

Based on the above, in the invention, the polarity controlling information is mounted on the image data stream or the data input/output indication signal, and the polarity controlling information is transmitted to source driver by ways of transmission through the existing image data stream or the data input/output indication signal. As a result, the source driver can effectively perform actions for controlling the polarities of the driving signals thereof without disposing extra pins for receiving the polarity controlling information, such that the circuit costs may be effectively reduced accordingly.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
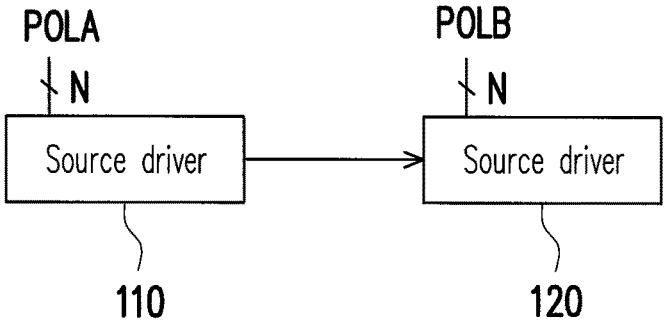
FIG. 1A, FIG. 1B and FIG. 1C are schematic diagrams illustrating various methods for controlling polarities of source driving signals in the conventional technology.
Figure 1B:
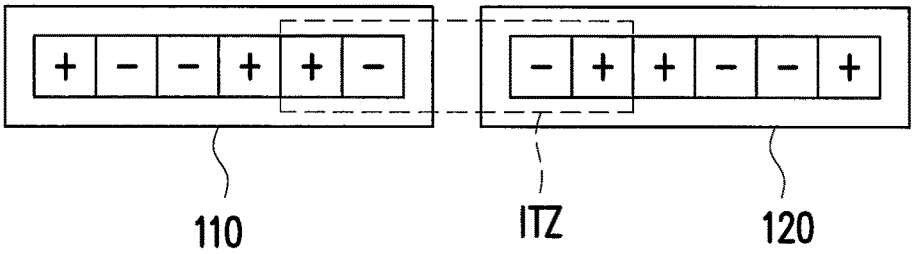
Figure 1C:
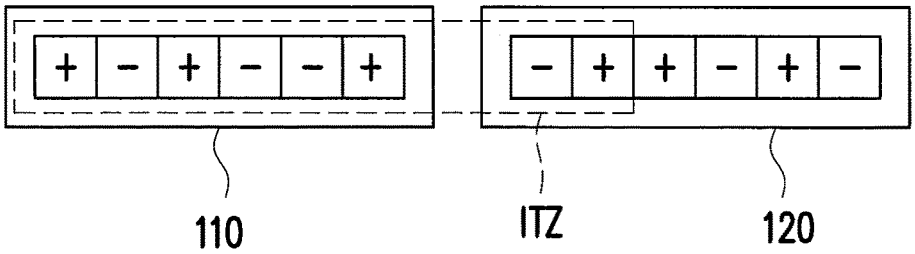

Reference will now be made in detail to the present preferred embodiments of the invention, examples of which are illustrated in the accompanying drawings. Wherever possible, the same reference numbers are used in the drawings and the description to refer to the same or like parts.

Figure 2:
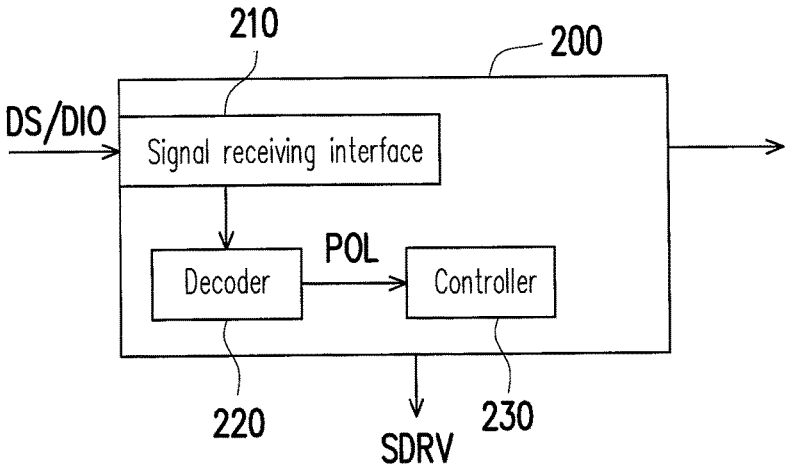
FIG. 2 illustrates a schematic diagram of a source driver according to an embodiment of the invention.

Referring to FIG. 2, FIG. 2 illustrates a schematic diagram of a source driver according to an embodiment of the invention. The source driver 200 includes a signal receiving interface 210, a decoder 220, and a controller 230. The signal receiving interface 210 may receive an image data stream DS or a data input/output indication signal DIO. Herein, the image data stream DS may be sent by a timing controller (TCON) in a liquid crystal display apparatus and received by the signal receiving interface 210, and the data input/output indication signal DIO may be sent by the timing controller or a previous-stage source driver and received by the signal receiving interface 210. The image data stream DS includes image data to be displayed by the liquid crystal display apparatus, and the data input/output indication signal DIO is information used to indicate a timing for the source driver 200 to receive or transmit data.

The decoder 220 is coupled to the signal receiving interface 210. The decoder 220 obtains polarity controlling information POL from the image data stream DS or the data input/output indication signal DIO. The controller 230 is coupled to the decoder 220 and receives the polarity controlling information POL obtained by the decoder 220. The controller 230 decides driving polarities of a plurality of source driving signals SDRV generated by the source driver 200 according to the polarity controlling information POL, and accordingly sets a driving polarity sequence for the source driving signals SDRV, so that the driving polarity sequence of the source driver 200 meets requirements for the horizontal two dot inversion and the H4 Inversion mechanisms.

In the present embodiment of the invention, the polarity controlling information POL is mounted on the image data stream DS or the data input/output indication signal DIO. As such, the source driver 200 may use the signal receiving interface 210 to obtain the polarity controlling information POL from the existing image data stream DS or the data input/output indication signal DIO That is to say, the source driver 200 may receive the polarity controlling information POL without disposing extra pins, so as to effectively reduce the circuit costs.

Figure 3:
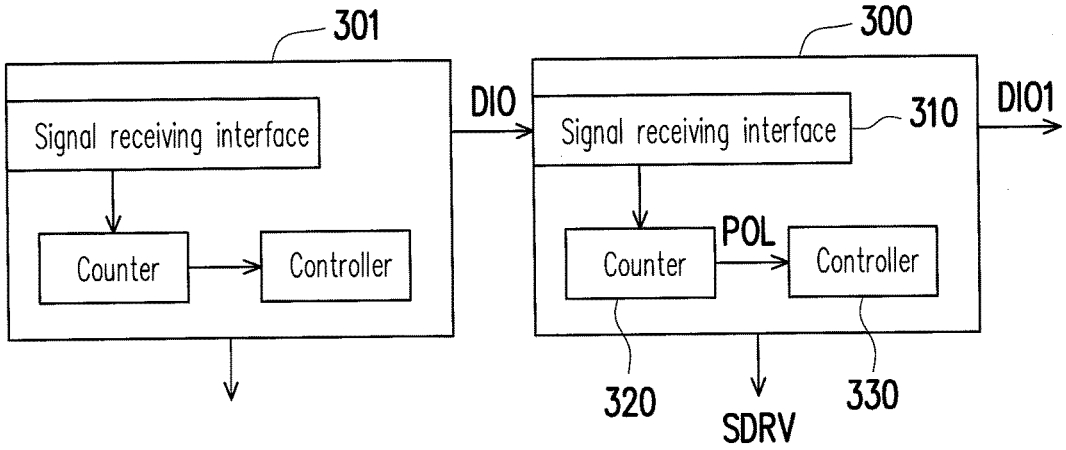
FIG. 3 illustrates a schematic diagram of a source driver according to another embodiment of the invention.

Referring to FIG. 3, FIG. 3 illustrates a schematic diagram of a source driver according to another embodiment of the invention. In FIG. 3, a source driver 300 is connected to a previous-stage source driver 301. The source driver 300 includes a signal receiving interface 310, a counter 320, and a controller 330. The source driver 300 receives the data input/output indication signal DIO from the previous-stage source driver 301 by the signal receiving interface 310, and transmits the data input/output indication signal DIO to the counter 320.

Under a low-voltage differential signal interface specification (mini-LVDS), the counter 320 may determine a channel quantity of the previous-stage source driver 301 by counting a starting time of the data input/output indication signal DIO. In other words, by counting the starting time of the data input/output indication signal DIO, a polarity state of the driving signal at an intersection of the previous-stage source driver 301 and the source driver 300 may be determined. Further, through the obtained polarity state of the driving signal at the intersection of the previous-stage source driver 301 and the source driver 300, the polarity controlling information POL may further be obtained according to a counting result generated by the counter 320.

Figure 4:
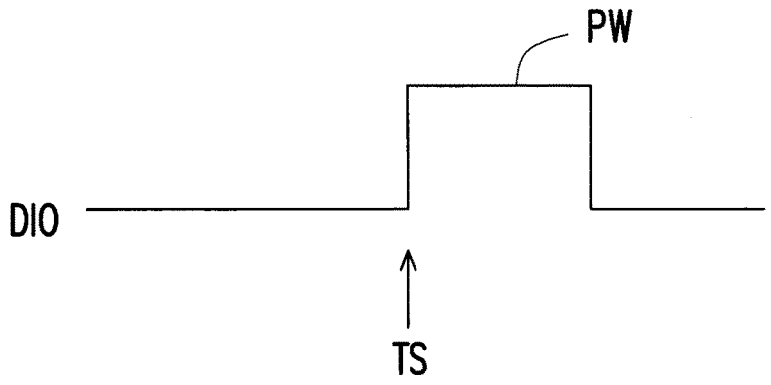
FIG. 4 illustrates a waveform diagram of the data input/output indication signal DIO according to an embodiment of the invention.

Details for obtaining the starting time of the data input/output indication signal DIO may refer to FIG. 4, which illustrates a waveform diagram of the data input/output indication signal DIO according to an embodiment of the invention. The data input/output indication signal DIO has a data input/output indication pulse PW, and the starting time of the data input/output indication signal DIO may be a time point when the data input/output indication pulse PW occurs (a time point TS when the data input/output indication signal DIO transforms to high logic level). The counter 320 may start a counting operation when the source driver 300 is reset and complete the counting operation at the time point TS, such that the polarity controlling information POL may be obtained according to the counting result generated by the counting operation. In addition, the counter 320 may be reset according to a horizontal synchronizing signal (HSYNC) received by the source driver 300 to restart the counting operation.

Referring back to FIG. 3, the counter 320 transmits the obtained polarity controlling information POL to the controller 330. Accordingly, the controller 330 may set the driving polarity sequence of the generated source driving signals SDRV according to the polarity controlling information POL. Further, the controller 330 may generate a secondary-stage data input/output indication signal DIO1 according to the polarity controlling information POL and the channel quantity for the driving signals of the source driver 300, and transmits the secondary-stage data input/output indication signal DIO1 to a secondary-stage source driver.

The secondary-stage data input/output indication signal DIO1 may be used to inform the secondary-stage source driver about a polarity variation state of the source driving signal at the intersection of the source driver 300 and the secondary-stage source driver, so that the secondary-stage source driver may accordingly set the polarity variation sequence for its generated source driving signals.

Figure 5:
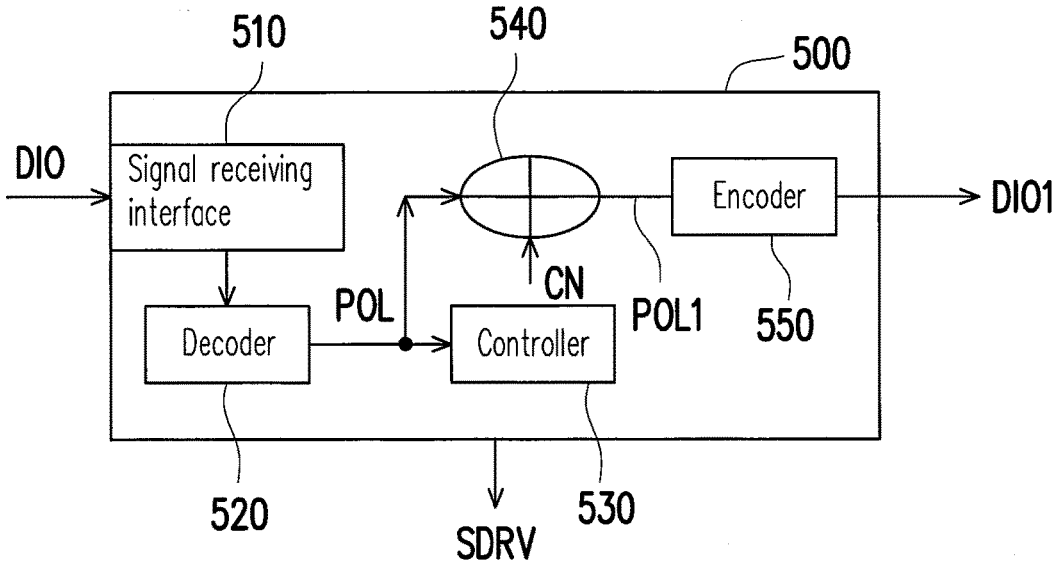
FIG. 5 illustrates a schematic diagram a source driver according to yet another embodiment of the invention.

Referring to FIG. 5, FIG. 5 illustrates a schematic diagram of a source driver according to yet another embodiment of the invention. In FIG. 5, a source driver 500 includes a signal receiving interface 510, a decoder 520, a controller 530, an operator 540 and an encoder 550. The signal receiving interface 510 receives the data input/output indication signal DIO, and the decoder 520 is used to obtain the polarity controlling information POL mounted in the data input/output indication signal DIO. The controller 530 may set the polarity sequence for the source driving signals SDRV according to the polarity controlling information POL.

It is worth mentioning that, in the present embodiment of the invention, the source driver 500 further includes the operator 540 and the encoder 550. The operator 540 receives the polarity controlling information POL and channel quantity information CN of the source driver 500, and calculates the polarity controlling information POL and the channel quantity information CN in order to generate secondary polarity controlling information POL1. The encoder 550 is coupled to the operator 540 and configured to receive the secondary-stage polarity controlling information POL1 and encodes the secondary-stage polarity controlling information POL1 so that the secondary-stage polarity controlling information POL1 is mounted on the secondary-stage data input/output indication signal DIO1. The decoder 550 then transmits the secondary-stage data input/output indication signal DIO1 to the secondary-stage source driver.

In the present embodiment, the operator 540 may be an adder.

Figure 6A:
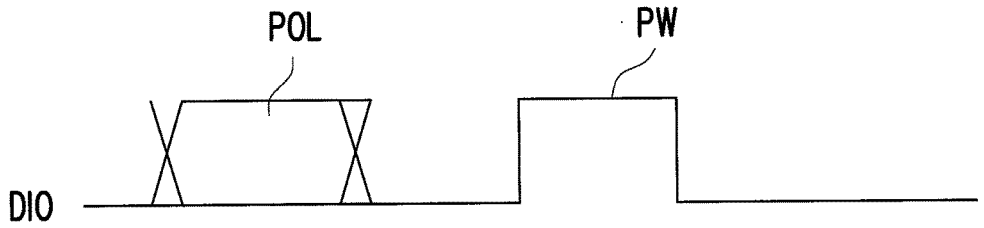
FIG. 6A and FIG. 6B are schematic diagrams illustrating a method for mounting the polarity controlling information according to an embodiment of the invention.
Figure 6B:
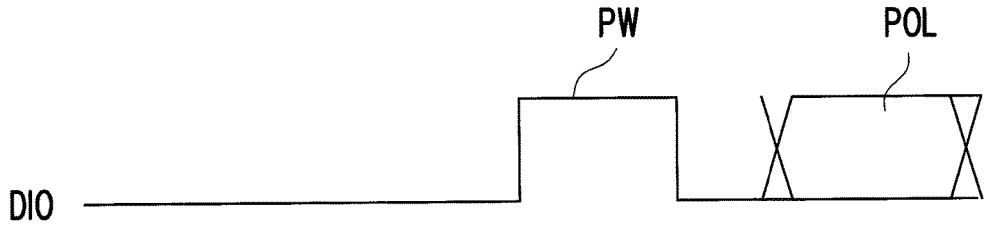

Further, referring to FIG. 6A and FIG. 6B, FIG. 6A and FIG. 6B are schematic diagrams illustrating a method for mounting the polarity controlling information according to an embodiment of the invention. In FIG. 6A, the polarity controlling information POL may be mounted in front of the data input/output indication pulse PW on the data input/output indication signal DIO and neighboring to the data input/output indication pulse PW. The polarity controlling information POL may represent its information content in a serial manner, and may be implemented by any representing method for serial data well-known by persons skilled in the art, which is not particularly limited.

In FIG. 6B, the polarity controlling information POL may be mounted at the back of the data input/output indication pulse PW on the data input/output indication signal DIO and neighboring to the data input/output indication pulse PW. Similarly, the polarity controlling information POL may represent its information content in a serial manner, and may be implemented by any representing method for serial data well-known by person skilled in the art, which is not particularly limited.

Figure 7:
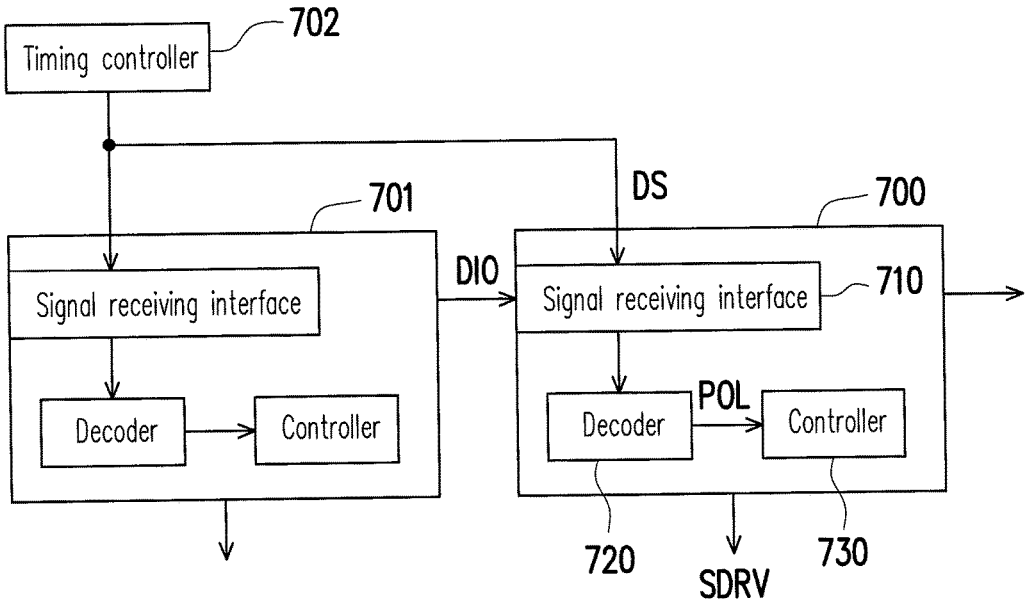
FIG. 7 illustrates a schematic diagram a source driver according to still another embodiment of the invention.

Referring to FIG. 7, FIG. 7 illustrates a schematic diagram of a source driver according to still another embodiment of the invention. A source driver 700 is coupled to a timing controller 702 and a previous-stage source driver 701. The source driver 700 includes a signal receiving interface 710, a decoder 720, and a controller 730. The source driver 700 receives the image data stream DS by the signal receiving interface 710, and obtains the polarity controlling information POL from the image data stream DS by the decoder 720 coupled to the signal receiving interface 710. The decoder 720 transmits the obtained polarity controlling information POL to the controller 730. The controller 730 sets the driving polarity sequence of the generated source driving signals SDRV according to the polarity controlling information POL.

In the present embodiment, the polarity controlling information (e.g., the polarity controlling information POL) corresponding to each stage may be set by the timing controller 702 in advance, and individually mounted in the image data stream DS. Subsequently, the timing controller 702 transmits each of the polarity controlling information to the corresponding source driver (e.g., the polarity controlling information POL is transmitted to the corresponding source driver 700).

Figure 8:
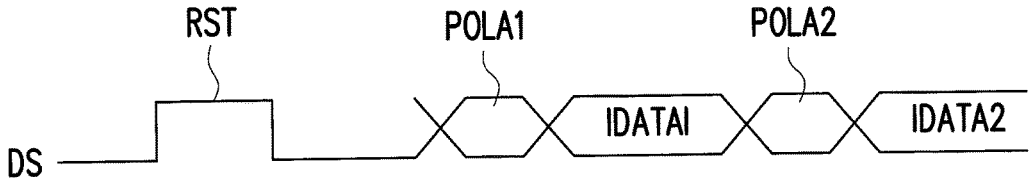
FIG. 8 is a schematic diagram illustrating a method for mounting the polarity controlling information according to an embodiment of the invention.

A method for the mounting the polarity controlling information POL may refer to FIG. 8, which is a schematic diagram illustrating a method for mounting the polarity controlling information according to an embodiment of the invention. In FIG. 8, polarity controlling information POLA1 and POLA2 may be mounted in an idle time interval of yet-transmitted image data IDATA1 and IDATA2, respectively. For instance, in FIG. 8, the polarity controlling information POLA1 transmitted to a first-stage source driver is mounted in front of a time interval for transmitting the image data IDATA1 of the first-stage source driver, whereas the polarity controlling information POLA2 of a second-stage source driver is mounted between two time intervals for transmitting the image data IDATA1 and IDATA2 of the first-stage and the stage source drivers, respectively.

In addition, a pulse RST may be a reference starting point of the image data stream DS for transmitting data.

Figure 9:
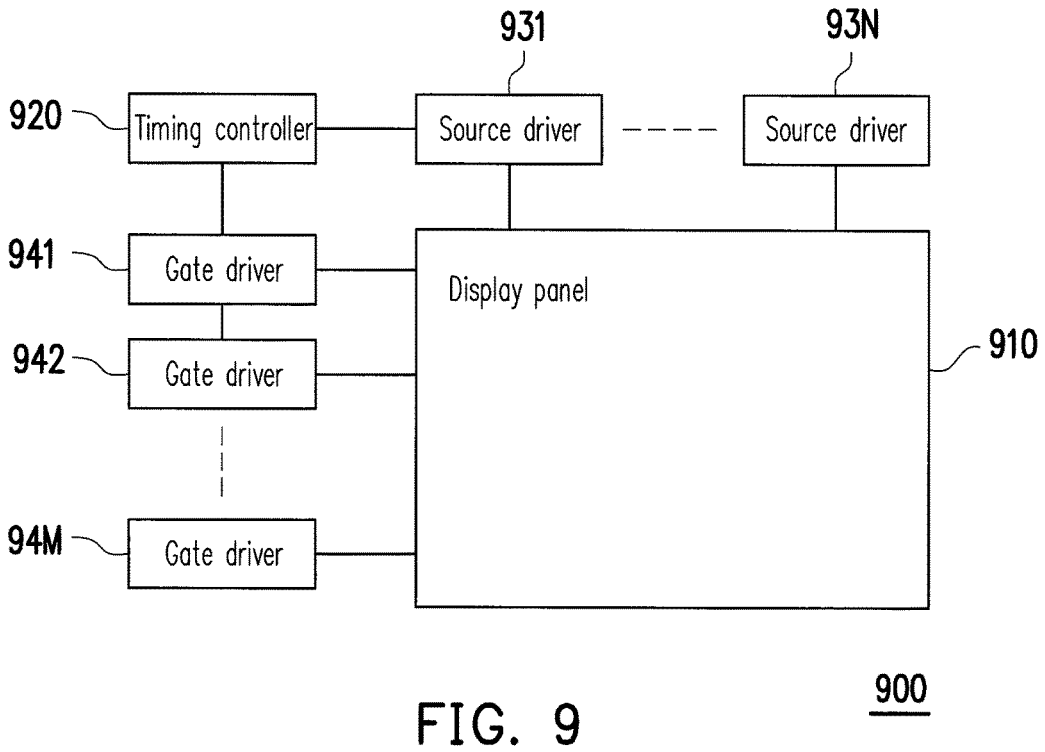
FIG. 9 illustrates a schematic diagram of a liquid crystal display apparatus 900 according to an embodiment of the invention.

Referring to FIG. 9, FIG. 9 is a schematic diagram illustrating a liquid crystal display apparatus 900 according to an embodiment of the invention. The liquid crystal display apparatus 900 includes a display panel 910, a timing controller 920, source drivers 931 to 93N and gate drivers 941 to 94M. The source drivers 931 to 93N are coupled to the display panel 910 and the timing controller 920, implemented by using the source drivers mentioned in the foregoing embodiment, and configured to generate the source driving signals in order to drive the display panel 910. The gate drivers 941 to 94M are coupled to the display panel 910 and the timing controller 920, and configured to generate gate driving signals in order to drive the display panel 910. Herein, the gate drivers 941 to 94M may be implemented by gate driver well-known by persons skilled in the art, which are not particularly limited.

It should be noted that, the source drivers 931 to 93N of the present embodiment do not need to dispose extra pins for receiving the polarity controlling information, instead, the existing image data stream or the data input/output indication signal are utilized to receive the polarity controlling information, so as to effectively reduce an area required by the circuit to thereby reduce circuit costs.

Figure 10:
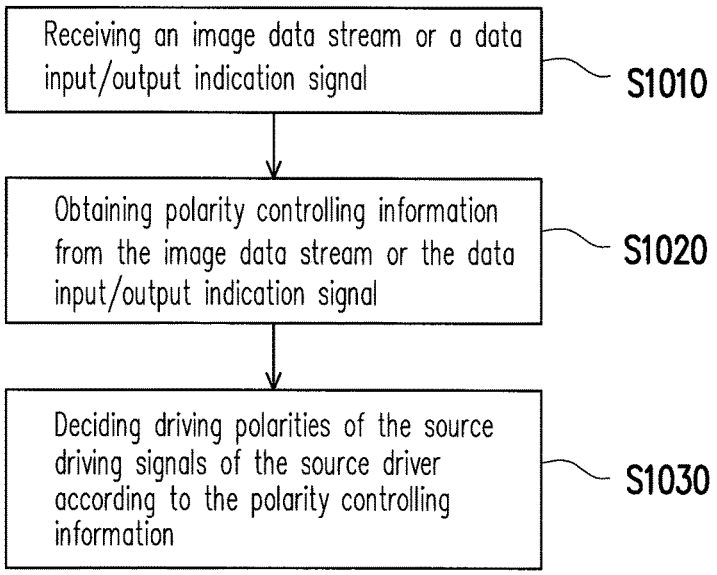
FIG. 10 illustrates a method for controlling polarities of driving signals of a source driver according to an embodiment of the invention.

Referring to FIG. 10, FIG. 10 illustrates a method for controlling polarities of driving signals of a source driver according to an embodiment of the invention. The method for controlling polarities of driving signals of a source driver is adapted to a liquid crystal display apparatus. In step S1010, an image data stream or a data input/output indication signal is received. Further, in step S1020, polarity controlling information is obtained from the image data stream or the data input/output indication signal. Subsequently, in step S1030, the polarity controlling information is received and driving polarities of a plurality of source driving signals generated by the source driver are decided according to the polarity controlling information.

Relevant implementation detail for the steps above has been described in the previous embodiments and implementations, which is not repeated hereinafter.

In summary, the invention utilizes the existing image data stream or the data input/output indication signal of the source driver to receive the polarity controlling information without needing extra pins to be disposed for transmitting the polarity controlling information, such that the circuit costs for the source driver may be effectively reduced to improve competitive advantage of the product in terms of price.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver, adapted to a liquid crystal display apparatus, comprising:

a signal receiving interface, receiving a data input/output indication signal;

a decoder, coupled to the signal receiving interface, and decoding the data input/output indication signal to obtain both of polarity controlling information and timing information for the source driver to receive or transmit data; and a controller, coupled to the decoder, receiving the polarity controlling information, and deciding driving polarities of a plurality of source driving signals generated by the source driver according to the polarity controlling information.

2. The source driver according to claim 1, wherein the signal receiving interface receives the data input/output indication signal from a timing controller or a previous-stage source driver.

3. The source driver according to claim 1, wherein the decoder calculates a starting time point of a data input/output indication pulse of the data input/output indication signal to obtain the polarity controlling information.

4. The source driver according to claim 1, further comprising:

a counter, coupled to the signal receiving interface and the controller, wherein the counter counts the starting time point of the data input/output indication pulse according to a timing signal in order to obtain the polarity controlling information.

5. The source driver according to claim 1, wherein the decoder decodes a signal neighboring to a data input/output indication pulse on the data input/output indication signal to obtain the polarity controlling information.

6. The source driver according to claim 1, further comprising:

an operator, receiving the polarity controlling information and channel quantity information, and calculating the polarity controlling information and the channel quantity information for generating secondary polarity controlling information of a secondary-stage source driver; and an encoder, coupled to the operator, receiving the secondary-stage polarity controlling information, encoding the secondary-stage polarity controlling information so that the secondary polarity controlling information is mounted on a secondary-stage data input/output indication signal, and transmitting the secondary-stage data input/output indication signal to the secondary-stage source driver.

7. A method for controlling polarities of driving signals of a source driver, adapted to a liquid crystal display apparatus, comprising:

receiving a data input/output indication signal;

decoding the data input/output indication signal to obtain both of polarity controlling information and timing information for the source driver to receive or transmit data; and deciding driving polarities of the source driving signals of the source driver according to the polarity controlling information.

8. The method for controlling the polarities of the driving signals according to claim 7, wherein the step of receiving the data input/output indication signal comprises:

receiving the data input/output indication signal from a timing controller or a previous-stage source driver.

9. The method for controlling the polarities of the driving signals according to claim 7, wherein the step of obtaining the polarity controlling information from the data input/output indication signal comprises:

calculating a starting time point of a data input/output indication pulse of the data input/output indication signal to obtain the polarity controlling information.

10. The method for controlling the polarities of the driving signals according to claim 7, wherein the step of obtaining the polarity controlling information from the data input/output indication signal comprises:

decoding a signal neighboring to a data input/output indication pulse on the data input/output indication signal to obtain the polarity controlling information.

11. The method for controlling the polarities of the driving signals according to claim 7, further comprising:

receiving the polarity controlling information and channel quantity information, and calculating the polarity controlling information and the channel quantity information in order to generate secondary polarity controlling information of a secondary-stage source driver; and encoding the secondary-stage polarity controlling information so that the secondary polarity controlling information is mounted on a secondary-stage data input/output indication signal, and transmitting the secondary-stage data input/output indication signal to the secondary-stage source driver.

12. A method for controlling polarities of driving signals of a source driver, adapted to a liquid crystal display apparatus, comprising:

receiving a data input/output indication signal from a timing controller or a previous-stage source driver;

obtaining polarity controlling information from the data input/output indication signal, wherein the polarity controlling information is obtained by decoding a signal neighboring to a data input/output indication pulse on the data input/output indication signal;

deciding driving polarities of the source driving signals of the source driver according to the polarity controlling information;

receiving the polarity controlling information and channel quantity information, and calculating the polarity controlling information and the channel quantity information in order to generate secondary polarity controlling information of a secondary-stage source driver; and encoding the secondary-stage polarity controlling information so that the secondary polarity controlling information is mounted on a secondary-stage data input/output indication signal, and transmitting the secondary-stage data input/output indication signal to the secondary-stage source driver.

* * * * *